US009664006B2

(12) United States Patent
Stave

(10) Patent No.: US 9,664,006 B2
(45) Date of Patent: May 30, 2017

(54) RISER ISOLATION DEVICE HAVING AUTOMATICALLY OPERATED ANNULAR SEAL

(71) Applicant: Enhanced Drilling, A.S., Straume (NO)

(72) Inventor: Roger Sverre Stave, Straume (NO)

(73) Assignee: Enhanced Drilling, A.S., Straume (NO)

( * ) Notice: Subject to any disclaimer, the term of this patent is extended or adjusted under 35 U.S.C. 154(b) by 0 days.

(21) Appl. No.: 14/864,925

(22) Filed: Sep. 25, 2015

(65) Prior Publication Data

US 2017/0089169 A1 Mar. 30, 2017

(51) Int. Cl.
*E21B 34/04* (2006.01)

(52) U.S. Cl.
CPC ..... *E21B 34/04* (2013.01)

(58) Field of Classification Search
CPC ..... E21B 41/00; E21B 7/12
See application file for complete search history.

(56) References Cited

U.S. PATENT DOCUMENTS 6,142,236 A * 11/2000 Brammer ..... E21B 7/12 166/351
7,958,948 B2 * 6/2011 Stave ..... E21B 21/08 166/344
8,413,724 B2 * 4/2013 Carbaugh ..... E21B 17/085 166/344
9,068,420 B2 * 6/2015 Rajabi ..... E21B 21/08
2008/0190663 A1 * 8/2008 Stave ..... E21B 21/08 175/7
2010/0175882 A1 * 7/2010 Bailey ..... E21B 33/085 166/335
2011/0278014 A1 * 11/2011 Hughes ..... E21B 21/001 166/367
2011/0315404 A1 * 12/2011 Bailey ..... E21B 21/015 166/387
2014/0048331 A1 * 2/2014 Boutalbi ..... E21B 21/08 175/38
2015/0144400 A1 * 5/2015 Leuchtenberg ..... E21B 34/00 175/25
2015/0204146 A1 * 7/2015 Wagoner ..... E21B 7/12 166/358
2016/0076306 A1 * 3/2016 Fossli ..... E21B 21/001 166/340
2016/0168934 A1 * 6/2016 Weinstock ..... E21B 7/12 175/7

* cited by examiner

*Primary Examiner* — Matthew R Buck
*Assistant Examiner* — Aaron Lembo
(74) *Attorney, Agent, or Firm* — Richard A. Fagin

(57) ABSTRACT

A device for control of return flow from a borehole, wherein drilling fluid is supplied from a drilling platform through a drill string disposed in a borehole includes an annulus formed between a pipe and the drill string. The annulus is in fluid communication with or forms part of a return path for the drill fluid. A choke is positioned in the annulus. An automatically operated annular seal element is disposed in the pipe above the drill fluid return path. The automatically operated annular seal element is configured to close the annulus to fluid communication when at least one of a predetermined fluid flow rate in the pipe and a predetermined pressure differential across the automatically operated annular seal element is reached.

10 Claims, 3 Drawing Sheets

RISER ISOLATION DEVICE HAVING AUTOMATICALLY OPERATED ANNULAR SEAL

CROSS REFERENCE TO RELATED APPLICATIONS

Not Applicable.

STATEMENT REGARDING FEDERALLY SPONSORED RESEARCH OF DEVELOPMENT

Not Applicable.

NAMES TO THE PARTIES TO A JOINT RESEARCH AGREEMENT

Not Applicable.

BACKGROUND

This disclosure relates to drilling wellbores in formations below the bottom of a body of water. The disclosure relates more particularly to wellbore pressure control apparatus used to prevent uncontrolled escape of fluids from such wellbores and the accompanying hazards associated with such uncontrolled escape.

Wellbores drilled through formations below the bottom of a body of water may use a conduit called a riser that extends from a drilling platform on the water surface to a wellhead or pressure control devices (blowout preventers—BOPs) proximate the bottom of the body of water. The riser may provide a guide for a drill string used to drill the wellbore and may serve as a conduit to return to the drilling platform some of all of a volume of drilling fluid ("mud") used in the drilling process. The mud is pumped from the drilling platform through the drill string. The mud column in the riser provides hydraulic pressure (related to the density of the mud, the vertical length of the riser, and hydrodynamic properties of the mud) to prevent entry into the wellbore of fluid from formations exposed by drilling the wellbore. The mud column constitutes a primary well barrier and in most cases overbalances formation pore fluid pressure. In some cases, the hydraulic pressure is insufficient to prevent flow of some fluids into the wellbore. Inflow of gas into the wellbore is particularly hazardous because as gas travels upwardly in the wellbore, and ultimately in the riser, it expands as the hydraulic pressure decreases with respect to vertical depth. Such expansion can then produce a self-progressing, increasing displacement of mud from the wellbore, further reducing hydraulic pressure in the wellbore and enabling more fluids to enter the wellbore. In such event, the primary well barrier is then lost and a well pressure control event may occur.

U.S. Pat. No. 8,413,724 issued to Carbaugh et al. describes a device for diverting gas in a riser. The device includes a user-controlled sealing element disposed in the riser that closes the annular space between the drill string and the riser. When the annular sealing element is closed, gas may be diverted into one or more conduits to enable venting the gas in a controlled manner. The device disclosed in the '724 patent requires the user to operate the annular sealing element. It is possible for gas to enter the wellbore undetected such that user operation of the annular sealing element is delayed enough to create a hazardous condition in the wellbore and/or the riser.

U.S. Pat. No. 9,068,420 issued to Rajabi et al. describes a passive choke that may be inserted into a riser. The passive choke provides a relatively small cross-section annular space between the riser and the drill string such that upward flow of fluid in the riser is limited. Drilling mud is returned mainly through a separate mud return line in fluid communication with the interior of the riser below the passive choke. No user action is required to make use of the passive choke disclosed in the '420 patent. However, full fluid closure of the wellbore still requires user operation of the BOPs or further pressure control devices located in the riser or proximate the drilling platform.

DETAILED DESCRIPTION

Figure 1:
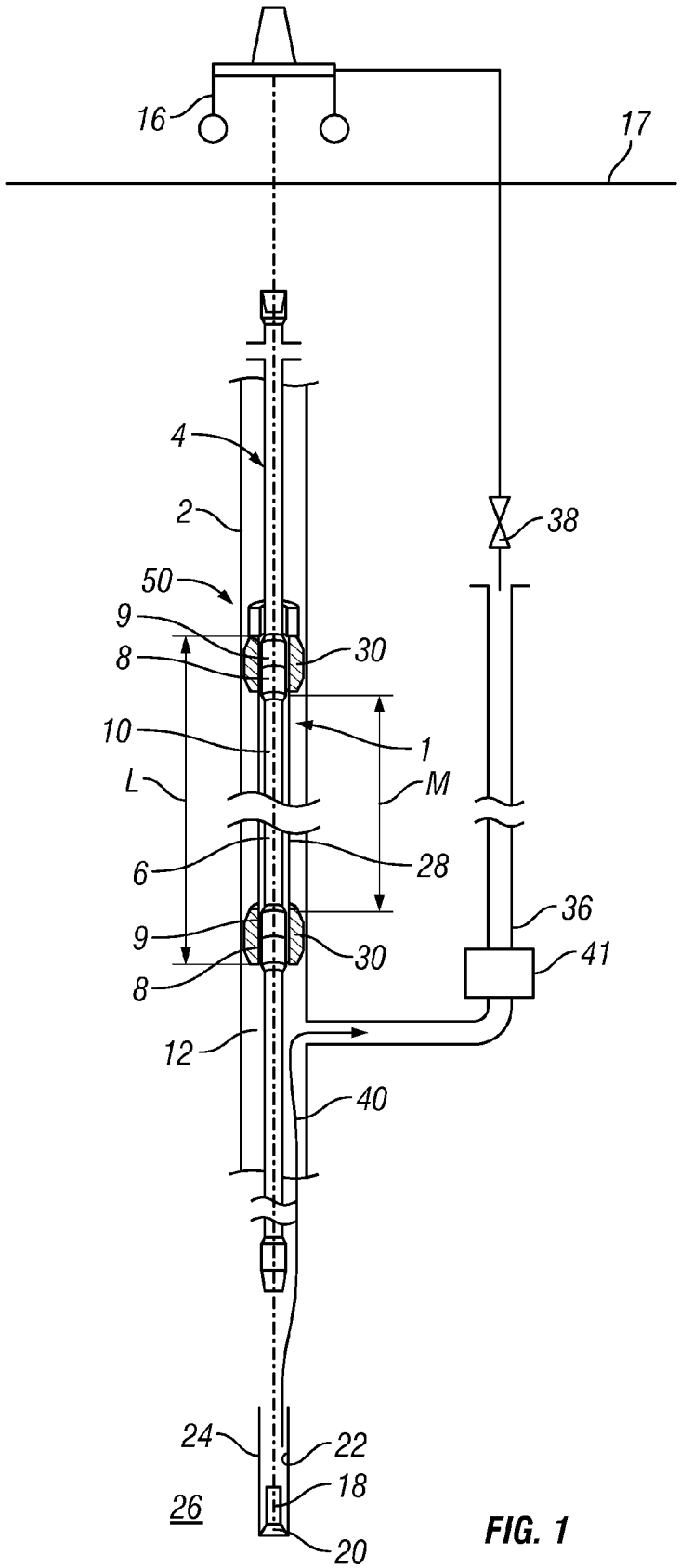
FIG. 1 shows schematically a choke and an automatically operated annular seal element positioned in a pipe wherein a fluid return line is connected to the pipe below the choke.

In FIG. 1, a choke 1 is positioned in a pipe 2, which may be in the form of a marine riser. A drill string 4 runs through the interior of the choke 1. The drill string 4 may be made up of drill pipe sections 6 having tool joints at the longitudinal ends thereof. The tool joints, consisting of a pin 8 and a box 9 have an enlarged outer diameter portion 9 compared to the outer diameter of a portion 10 of each drill pipe section 6 between the tool joints. An annulus 12 is formed between the pipe 2 and the drill string 4. The choke 1 is positioned in the annulus 12 and connected to an annular sealing element 50 kept in axial position in the pipe 2 by locking dogs (FIG. 2) which engage the interior wall of the pipe 2.

The drill string 4 extends between a drilling platform 16 on the water surface 17 and a bottom hole assembly 18 that includes a drill bit 20, and is positioned in a borehole 22. The borehole 22 may extend into a formation 24 of a well 26.

In the present example embodiment the choke 1 may include a cylinder 28 that extends between and may be sealingly connected to a body 30 at each of its longitudinal end portions. A length L of the choke 1 exceeds the distance M between the enlarged diameter portions 9 of two adjacent tool joints 8.

As shown in FIG. 1, a drill fluid return line 36 is connected to the pipe 2 at a position below the choke 1 and leads to the drilling platform 16. The drill fluid return line may be equipped with a choke valve 38. In some embodiments, the drill fluid return line 36 may include a pump 41 therein to enable controlling the fluid pressure in the borehole 22 and in the pipe 2 using methods well known in the art.

When in operation, drill fluid is pumped from the drilling platform 16 through the drill string 4 to the drill bit 20 of the bottom hole assembly 18. From the drill bit 20 the drill fluid, that carry with it cuttings, has a drill fluid return path to the drill rig 16 as indicated by the arrow 40. The drill fluid return path 40 includes the borehole 20, a lower part of the pipe 2, the drill fluid return line 36 and the choke valve 38.

A relatively narrow opening between each body 30, cylinder 28 and a tool joint (i.e., pin 8 and box 9) disposed therein has a substantial choking effect; thus gas is inhibited from expanding uncontrolled up the pipe 2. Further, the pressure of fluid flowing upwardly in the pipe 2 will be increased by the flow restriction provided by the choke 1. The pressure increase may be used in some embodiments to facilitate automatic operation of an automatically operated seal element 50 which may be disposed at one longitudinal end of the choke 1. The Bernoulli forces created by the choke 1 will also create a force that will aid in moving the choke 1 upward to close the automatically operated seal element 50. The automatically operated annular seal element 50 may be configured to close the annulus 12 between the interior of the pipe 2 and the exterior of the drill string 4, for example, when fluid pressure in the pipe 2 below the automatically operated annular seal element 50 exceeds the fluid pressure in the pipe 2 above the automatically operated annular seal element 50 by a selected or predetermined pressure difference. In other embodiments, the automatically operated annular seal element 50 may be configured to close the annulus 12 when flow of fluid upward in the pipe 12 exceeds a selected or predetermined flow rate.

Figure 2:
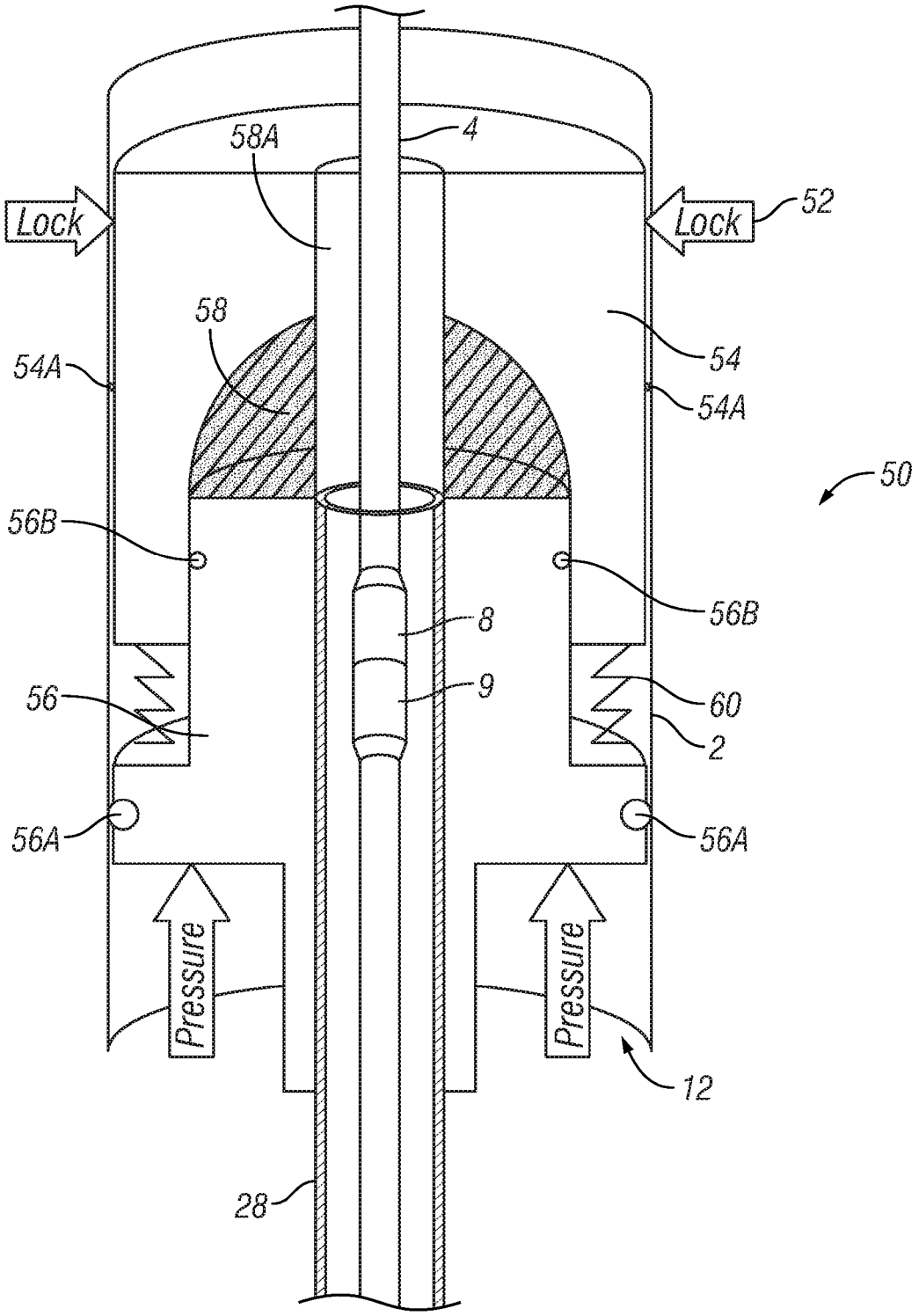
FIG. 2 shows an example embodiment of the automatically operated annular seal element in more detail.

The automatically operated annular seal element 50 is shown in more detail in FIG. 2. The automatically operated annular seal element 50 may comprise a seal housing 54 made, for example, from a high strength material such as steel. An outer diameter of the seal housing 54 may be selected to fit within the interior of the pipe 2 (e.g., a riser) with sufficient clearance to enable movement of the seal housing 54 in the pipe 2 but small enough clearance to energize seal elements 54A such as o-rings or other suitable sealing elements. The seal housing 54 may be retained in a selected axial position within the pipe 2 using locking dogs 52 of any type known in the art for retaining a device axially inside a conduit or pipe.

A piston 56 may be disposed inside the seal housing 54 and may be axially movable with respect to the seal housing 54. An external seal 56B such as an o-ring 56B may provide a pressure tight seal between the seal housing 54 and the piston 56. In some embodiments, the piston 56 may be disposed on an exterior surface of the cylinder 28 such that the piston 56 is free to move axially along the cylinder 28. The piston 56 may also be sealingly engaged with the interior of the pipe 2 using an external seal 56A such as an o-ring. In the present embodiment, a biasing device 60 such as a spring may provide force that urges the piston 56 away from the seal housing 54 so that the position of the piston 56, absent higher fluid pressure in the pipe 2 blow the automatically operated annular seal element 50, keeps the automatically operated seal element 50 open. A force rate of the biasing device 60 may be selected such that the selected pressure difference or the selected flow rate required to close the automatically operated annular seal element 50 is obtained. In the present example embodiment, the weight of the choke (1 in FIG. 1) may assist in keeping the automatically operated seal element open 50 even if a biasing device is not used.

An upper end of the piston 56 may be in contact with an annular closure element 58. The annular closure element may be made, for example from suitable types of elastomer and have an opening 58A such that when the piston 56 is extended away from the seal housing 54, the opening 58A has a large enough diameter to enable free movement therethrough of the drill string 4 and tool joint (pin 8 and box 9). An example embodiment of an annular closure element is described in U.S. Pat. No. 8,413,724 issued to Carbaugh et al.

When fluid pressure in the pipe 2 below the automatically operated seal element 50 exceeds fluid pressure in the pipe 2 above the automatically operated seal element 50, as shown by arrows in FIG. 2, the piston 56 is urged toward the seal housing 54 and compresses the annular closure element 58. Compression of the annular closure element 58 reduces the area of the opening 58A, thus enabling pressure below the piston 56 to further increase. Such further pressure increase urges the piston 56 further into the seal housing 54 and against the annular closure element 58 such that the annular closure element 58 eventually seals between the drill string 4 and the seal housing 54. In such condition, the pipe 2 is thereby closed to fluid communication through the automatically operated annular seal element 50. Closure of fluid communication in the pipe 2 may prevent further upward movement of gas in the pipe 2 and its associated hazards. Mud return from the borehole (22 in FIG. 1) is thus fully diverted through the drill fluid return line (36 in FIG. 1) and the choke valve (38 in FIG. 1) and/or the pump (40 in FIG. 1) if either or both of the foregoing is used.

In some embodiments, the automatically operated annular seal element 50 may be disposed in the pipe 2 above the choke (1 in FIG. 1). In such embodiments, the flow restriction provided by the choke (1 in FIG. 1) may reduce the possibility that the automatically operated annular seal element 50 closes against rapidly increasing fluid pressure and/or high fluid flow rates in the pipe 2. Such arrangement may facilitate sealing the annular closure element 58 against the drill string (6 in FIG. 1) and may reduce the possibility of failure of the annular closure element 58 as a result of high differential pressure or high fluid flow rate.

Figure 3:
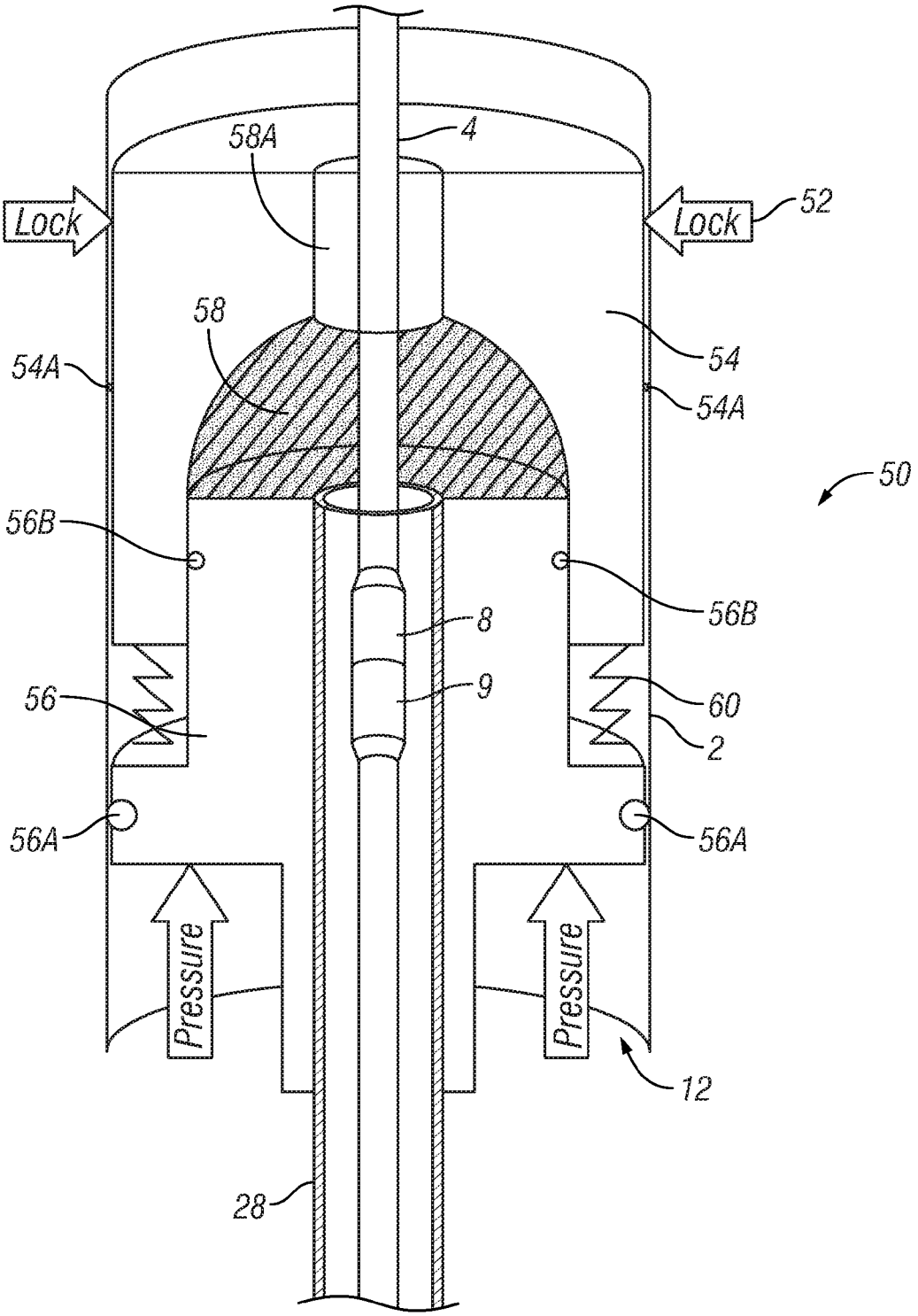
FIG. 3 shows another embodiment of mounting for the automatically operated annular seal element to a choke cylinder.

Referring to FIG. 3, in some embodiments, one of the bodies (30 in FIG. 1) of the choke may be substituted by a centralizer 8A affixed to the cylinder 28.

A pipe having a choke and an automatically operated annular seal element according to the present disclosure may provide increased safety by reducing flow rate of fluid upwardly in the pipe 2 by reason of the choke (1 in FIG. 1) and by automatically closing the pipe 2 to fluid flow other than through a separate drilling fluid return line. Automatically closing the pipe 2 to fluid flow may reduce the hazards associated with the need for the drilling platform operator to identify fluid influx into the borehole (22 in FIG. 1) before operating a seal element to prevent upward flow of fluid in the pipe 2. In other embodiments, the choke (1 in FIG. 1) may be omitted, and flow in the pipe 2 may be controlled using only the automatically operated annular seal element 50. In any embodiment, closure of the automatically operated annular seal element 50 may be assisted by suitable operation of the pump (41 in FIG. 1) and/or the choke (38 in FIG. 1) in the return path (40 in FIG. 1).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A device for control of return flow from a borehole, wherein drilling fluid is supplied from a drilling platform through a drill string disposed in a borehole, the device comprising:

an annulus formed between a pipe and the drill string, the annulus being in fluid communication with or forming part of a return path for the drill fluid, the pipe extending from the borehole to the drilling platform;

a choke positioned in the annulus, the choke comprising a cylinder disposed between two spaced apart bodies in an interior of the pipe, the spaced apart bodies disposed in an annular space between the interior of the pipe and an exterior of the cylinder, the choke comprising an annular space between an interior of the cylinder and an exterior of the drill string; and an automatically operated annular seal element disposed in the pipe above the drill fluid return path, the automatically operated annular seal element being open to fluid flow in the annular space between the interior of the cylinder and the exterior of the drill string when fluid flow rate in the pipe and differential pressure across the choke are below respective selected amounts, the annular seal element disposed in a housing adjacent to a piston movable along the exterior of the cylinder at one longitudinal end of the cylinder, the housing sealingly engaged with the interior of the pipe, the annular seal element configured to close the annulus between the interior of the pipe and the exterior of the drill string to fluid communication when at least one of a selected fluid flow rate in the pipe and a selected pressure differential across the choke is reached.

2. The device of claim 1 wherein the automatically operated annular seal element comprises a seal housing sealingly engaged with an interior of the pipe, a piston sealingly engaged with and axially movable with respect to an internal opening in the seal housing and sealingly engaged with an interior of the pipe and an annular closure element in contact with the piston such that movement of the piston toward the seal housing closes an opening in the annular closure element.

3. The device of claim 2 wherein the annular closure element comprises elastomer.

4. The device of claim 1 wherein the choke is disposed in the pipe below the automatically operated annular seal element.

5. A method for controlling flow of fluid out of a borehole, comprising:

moving fluid into the borehole through a drill string disposed therein;

returning the fluid from the borehole through a pipe connected and extending between the borehole and a drilling platform, the returning comprising moving the fluid from the pipe to a mud return path in fluid communication with an interior of the pipe;

restricting flow of fluid in the pipe between the drill string and an interior of the pipe at a position above the mud return path, the restricting comprising diverting flow in the pipe into an annular space between the drill string and an interior of a cylinder extending between two longitudinally spaced apart bodies disposed in the pipe, the bodies disposed in an annular space between an interior of the pipe and an exterior of the cylinder; and automatically closing an annulus between a housing disposed in the pipe and the drill string when at least one of an upward flow rate of fluid in the pipe and a pressure difference across an annular seal element disposed between an interior of the housing and an exterior of the drill string exceeds a selected amount the housing disposed at one end of the cylinder and sealingly engaged to the interior of the pipe, the housing having a piston movable along the interior of the pipe.

6. The method of claim 5 wherein the automatically closing the annulus comprises automatically operating an annular seal element comprising a seal housing sealingly engaged with an interior of the pipe, a piston sealingly engaged with and axially movable with respect to an internal opening in the seal housing and sealingly engaged with an interior of the pipe and an annular closure element in contact with the piston such that movement of the piston toward the seal housing closes an opening in the annular closure element.

7. The method of claim 6 wherein the annular closure element comprises elastomer.

8. The method of claim 5 further comprising restricting flow of fluid in the annulus.

9. The method of claim 8 wherein the restricting flow is performed in the pipe below a position of the automatically closing the annulus.

10. The method of claim 5 further comprising restricting flow in the return path.

* * * * *